US008365911B2

(12) United States Patent
Oh

(10) Patent No.: US 8,365,911 B2
(45) Date of Patent: Feb. 5, 2013

(54) MATTRESS TRANSPORTING ROLLER BOX

(75) Inventor: Suk Kan Oh, Xiamen (CN)

(73) Assignee: Zinus, Inc., Hayward, CA (US)

( * ) Notice: Subject to any disclaimer, the term of this patent is extended or adjusted under 35 U.S.C. 154(b) by 1083 days.

(21) Appl. No.: 11/541,368

(22) Filed: Sep. 30, 2006

(65) Prior Publication Data

US 2007/0074983 A1 Apr. 5, 2007

(30) Foreign Application Priority Data

Feb. 23, 2006 (CN) ..... 2006 2 0055540 U

(51) Int. Cl.
*B65D 85/00* (2006.01)
*B62D 1/02* (2006.01)

(52) U.S. Cl. ..... 206/389; 206/326; 280/47.131

(58) Field of Classification Search ..... 206/326, 206/389; 280/47.131
See application file for complete search history.

(56) References Cited

U.S. PATENT DOCUMENTS

| | | | | |
|---|---|---|---|---|
| 3,519,190 A | | 7/1970 | Achermann et al. | 229/37 |
| 4,711,067 A | | 12/1987 | Magni | 53/439 |
| 5,934,041 A | | 8/1999 | Rudolf et al. | 53/118 |
| D421,326 S | * | 2/2000 | Lewis | D34/24 |
| 6,039,243 A | * | 3/2000 | Lickton | 229/117.01 |
| 6,098,378 A | | 8/2000 | Wyatt | 53/430 |
| 6,315,368 B1 | * | 11/2001 | Kuo | 301/111.01 |
| 6,739,107 B1 | * | 5/2004 | Lewis et al. | 53/118 |
| 6,901,722 B2 | * | 6/2005 | Dextraze et al. | 53/399 |
| 2005/0269791 A1 | | 12/2005 | Hoiriis et al. | 280/47.131 |

FOREIGN PATENT DOCUMENTS

| | | |
|---|---|---|
| DE | 19910633 A1 | 3/1999 |
| EP | 1327586 A1 | 1/2003 |
| FR | 2741852 A1 | 11/1995 |

OTHER PUBLICATIONS

International Search Report and Written Opinion of International Searching Authority for PCT/US07/02221 dated Nov. 29, 2007 (9 pages).
Supplementary European Search Report for EP 07749329 dated Dec. 14, 2009 (5 pages).

* cited by examiner

*Primary Examiner* — J. Gregory Pickett
*Assistant Examiner* — Ernesto Grano
(74) *Attorney, Agent, or Firm* — Imperium Patent Works; T. Lester Wallace; Darien K. Wallace

(57) ABSTRACT

A roller box assembly includes a roller box and a bedding product contained in the roller box. The roller box includes a cardboard box portion, a pair of fixed-axis wheels, and a handle. The fixed-axis wheels are disposed along a corner edge of a bottom portion of the box portion. The handle portion is attached to the top portion of the box portion. In one embodiment, the bedding product is a mattress that has been compressed and rolled into a cylinder shape. A retail customer can purchase the bedding product at a retail store, and can then transport the purchased product out of the store by pulling the box from the handle such that the box rolls on its rollers.

12 Claims, 6 Drawing Sheets

MATTRESS TRANSPORTING ROLLER BOX

CROSS REFERENCE TO RELATED APPLICATION

This application is based on and hereby claims the benefit under 35 U.S.C. §119 from Chinese Patent Application No. 200620055540.0, filed on Feb. 23, 2006, in China, the contents of which are hereby incorporated by reference. This application is a continuation of Chinese

TECHNICAL FIELD

The described embodiments relates to a roller box, and more particularly to a roller box assembly for retaining and transporting a bedding product.

BACKGROUND INFORMATION

In the retail sale of mattresses, it can be difficult for the customer to purchase and take home a mattress due to the size and weight of the mattress. The difficulty and cost of scheduling a delivery to the customer's home can serve as an impediment to a sale. It is, however, now known to compress a mattress and to provide the mattress to the customer in a compressed state in a box at the retail store.

FIG. 1 (Prior Art) is a perspective view of the top 1 and the sides 2 and 3 of one such box 4. FIG. 2 is a perspective view of the bottom 5 and sides 2 and 3 of the box 4 of FIG. 1. Box 4 contains a compressed and rolled foam mattress. Box 4 has a substantially cubical shape that is about three feet on a side. The customer may extend his/her arms forward, and push on the top surface of the box, thereby causing the box to roll on four casters 6-9 in front of the customer. In this way, the customer who has purchased the mattress can roll the mattress in box 4 out of the store and to the customer's vehicle. Provided that the customer has an adequately large vehicle, the customer can transport the mattress home in its box without having to schedule a delivery and to wait for delivery of the mattress. Improvement in this shipping and delivery mechanism is desired.

SUMMARY

A roller box assembly includes a roller box and a bedding product contained in the roller box. The roller box includes a box portion, a pair of fixed-axis wheels, and a handle. In one embodiment, the box portion is made of cardboard. The fixed-axis wheels are disposed along a corner edge of a bottom portion of the box portion. The handle portion is attached to the top portion of the box portion. Each of the fixed-axis wheels has an axis that extends in a line. The line is disposed between the plane of the upper surface of the top portion and the plane of the bottom surface of the bottom portion. The line is parallel to the two planes, and does not intersect either plane. In one embodiment, the bedding product is a coil form innerspring mattress that has been compressed and placed in a first bag. The compressed and bagged mattress is then rolled into a cylindrical shape. The resulting rolled structure is taped to hold the cylindrical shape, and is placed in a cylindrical-shaped second bag to prevent the rolled mattress from unrolling and putting undue outward pressure on the box portion.

The roller box is used in a novel method whereby a retail customer purchases a mattress in a retail store, and then transports the mattress out of the retail store by pulling on the handle of the roller box assembly and thereby rolling the roller box out of the store on the two fixed-axis wheels of the roller box.

Further details and embodiments are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Figure 1:
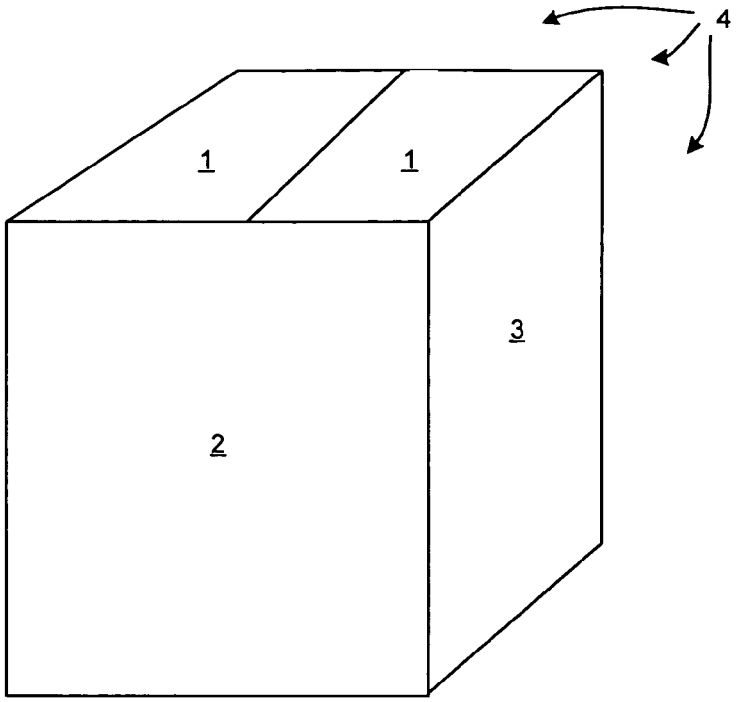
(PRIOR ART) FIG. 1
FIGS. 1-2 (Prior Art) are perspective views of a box that contains a compressed foam mattress.
Figure 2:
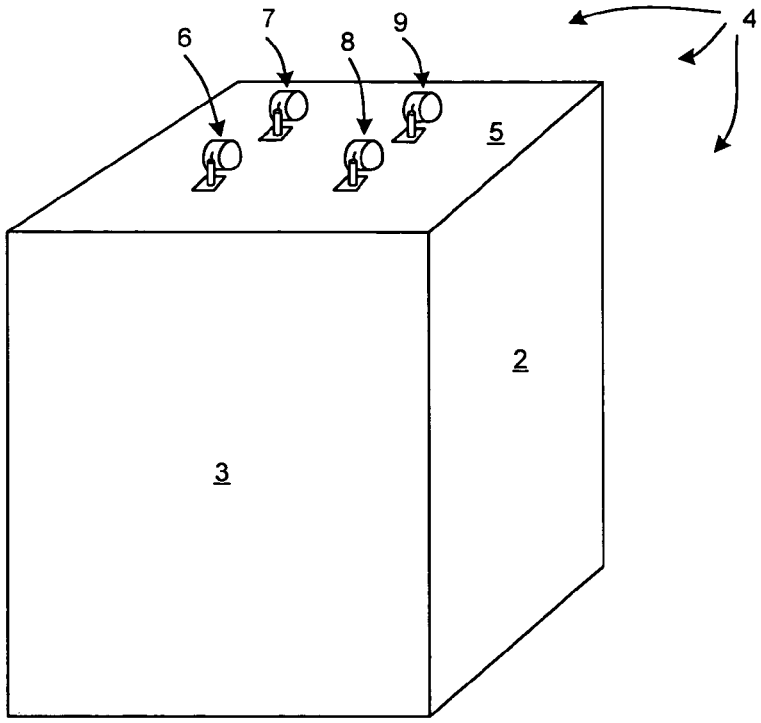
(PRIOR ART) FIG. 2
Figure 3:
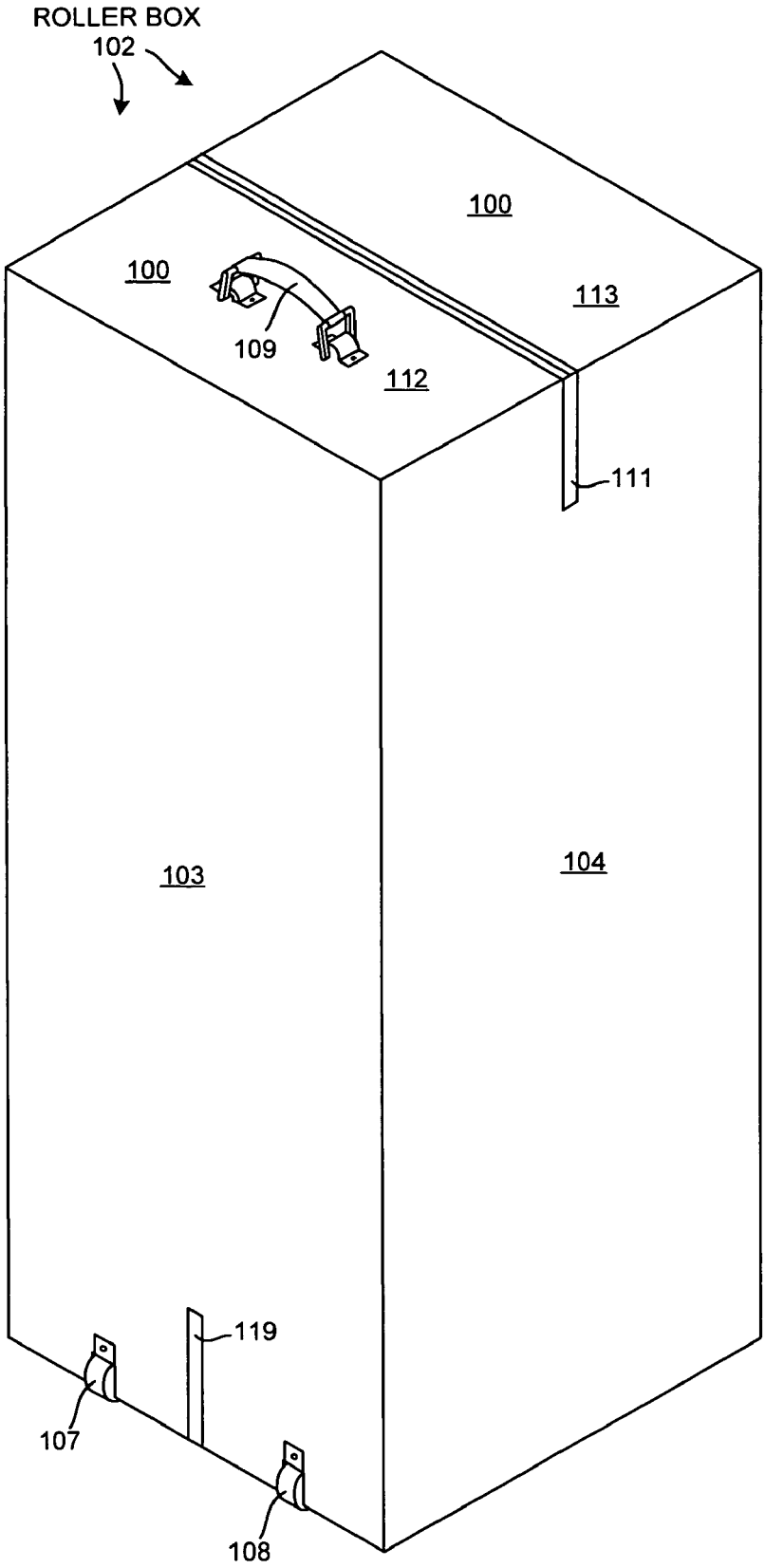
FIG. 3 is a perspective view of a top portion of a box portion of a roller box assembly in accordance with one novel aspect.
Figure 4:
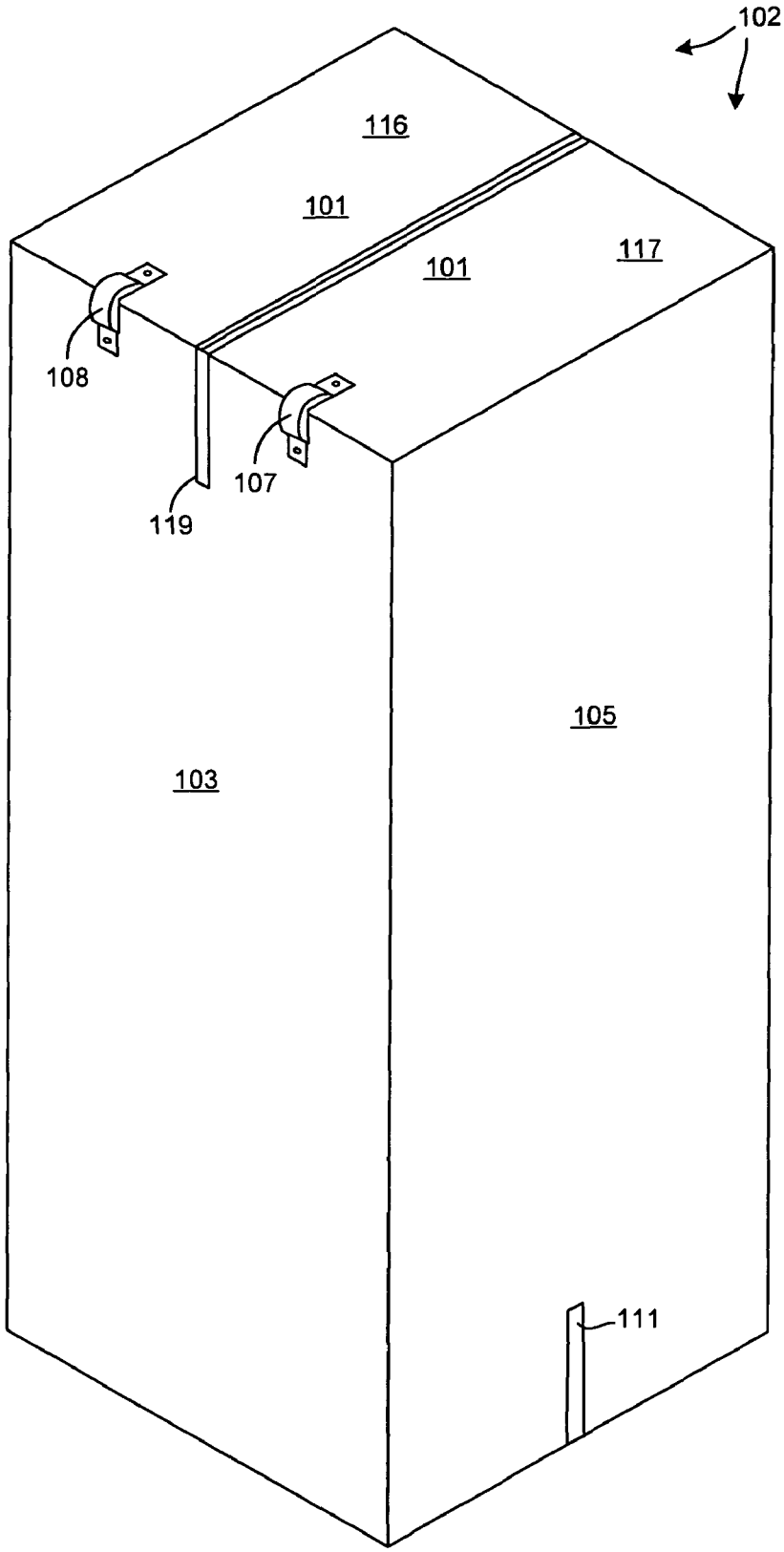
FIG. 4 is a perspective view of a bottom portion of the box portion of the roller box assembly of FIG. 3.

FIG. 3 is a top-down perspective diagram of a top portion 100 of a box portion of a roller box assembly in accordance with one novel aspect. FIG. 4 is a perspective view of a bottom portion 101 of the box portion of the roller box assembly of FIG. 3. The roller box assembly includes a roller box 102 and a bedding product (not shown, see FIGS. 9 and 10) that is disposed within the roller box. Roller box 102 includes the box portion, a first fixed-axis wheel 107, a second fixed-axis wheel 108, and a handle 109. The box portion includes the top portion 100, four sidewalls 103-106, and the bottom portion 101. A linearly-extending corner edge 110 is formed where the bottom portion 101 meets sidewall 103. Each of the fixed-axis wheels 107 and 108 is disposed along the corner edge 110 such that the axes of wheels 107 and 108 are substantially collinear and extend parallel to corner edge 110. Top portion 100 includes four flaps, where each of the flaps extends from one of the four sidewalls. The flaps are folded over the enclosed volume of the box to form top portion 100. In FIG. 3, a piece of tape 111 is illustrated holding top flaps 112 and 113 down and in place. The other two top flaps 114 and 115 are not illustrated because they are covered by top flaps 112 and 113 in the view of FIG. 3.

Bottom portion 101 includes a first bottom flap 116, a second bottom flap 117, and a bottom insert portion 118. First bottom flap 116 extends from sidewall 104. Second bottom flap 117 extends from sidewall 105. The first and second bottom flaps 116 and 117 are folded over and into the same plane so as to form a planar bottom surface of the box portion. Bottom insert portion 118 (also referred to as the "inner plate" of the bottom portion) may be made of a cardboard material that is more rigid than the plurality of sidewalls. In FIG. 4, a piece of tape 119 is illustrated holding first and second bottom flaps 116 and 117 folded over and in place.

Figure 5:
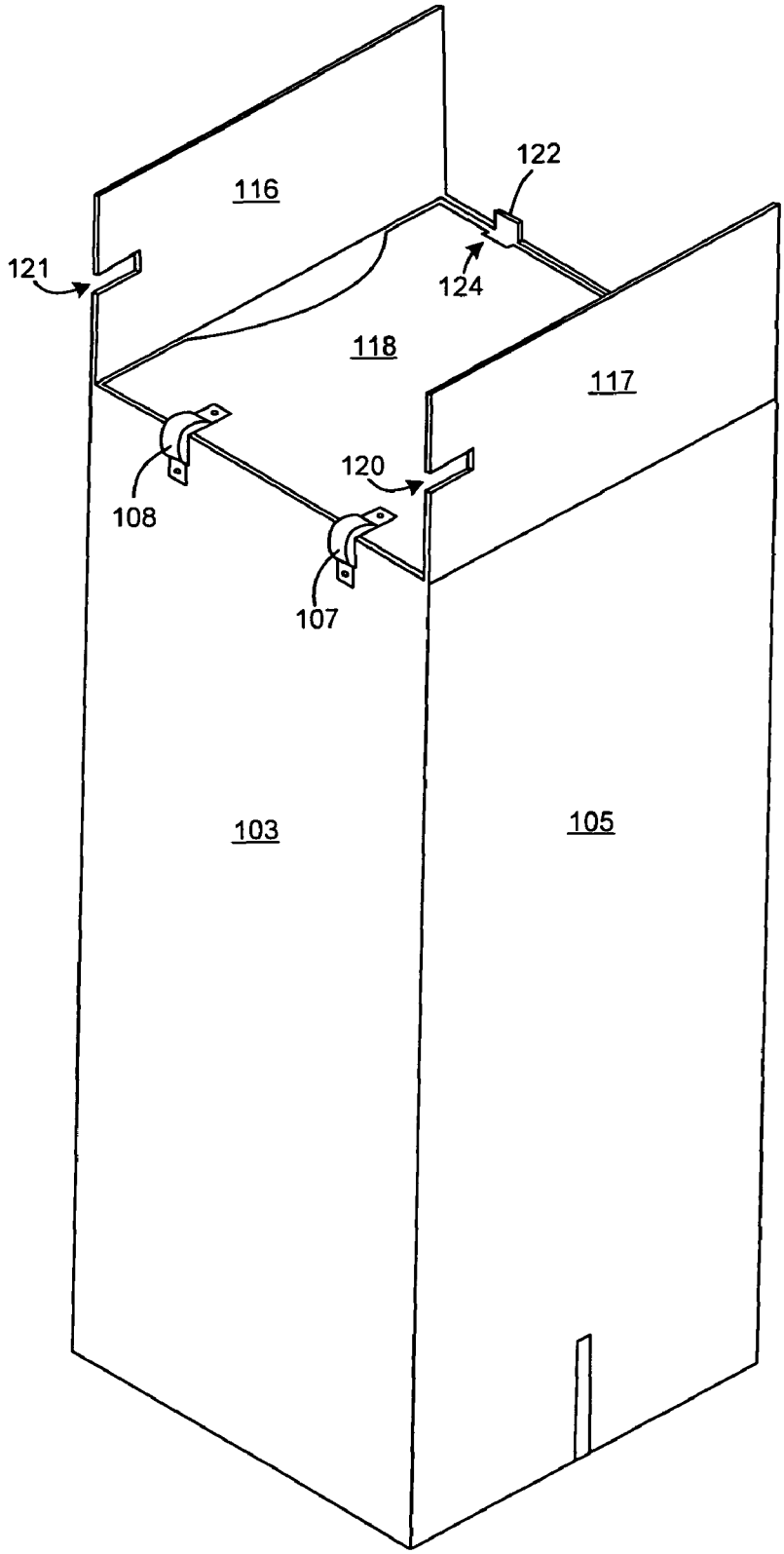
FIG. 5 is a perspective view of the bottom portion of the box portion of the roller box assembly of FIG. 3, showing the first and second bottom flaps opened to reveal the bottom insert portion.

FIG. 5 is a perspective diagram that shows the tape 119 removed and that shows the first and second bottom flaps 116 and 117 opened to reveal bottom insert portion 118. Bottom insert portion 118 has a bottom surface disposed in a first plane. This first plane is parallel to the planar bottom surface of the box formed by the first and second flaps 116 and 117 when flaps 116 and 117 are folded down. Notches 120 and 121 are provided in flaps 117 and 116, respectively, to accommodate and fit around wheels 107 and 108, respectively. Tab extension portions 122 and 123 of sidewall 106 fit into accommodating receiving slits 124 and 125 in bottom insert portion 118. A top surface (not shown) of bottom insert portion 118 forms the actual inside bottom surface of the roller box.

Figure 6:
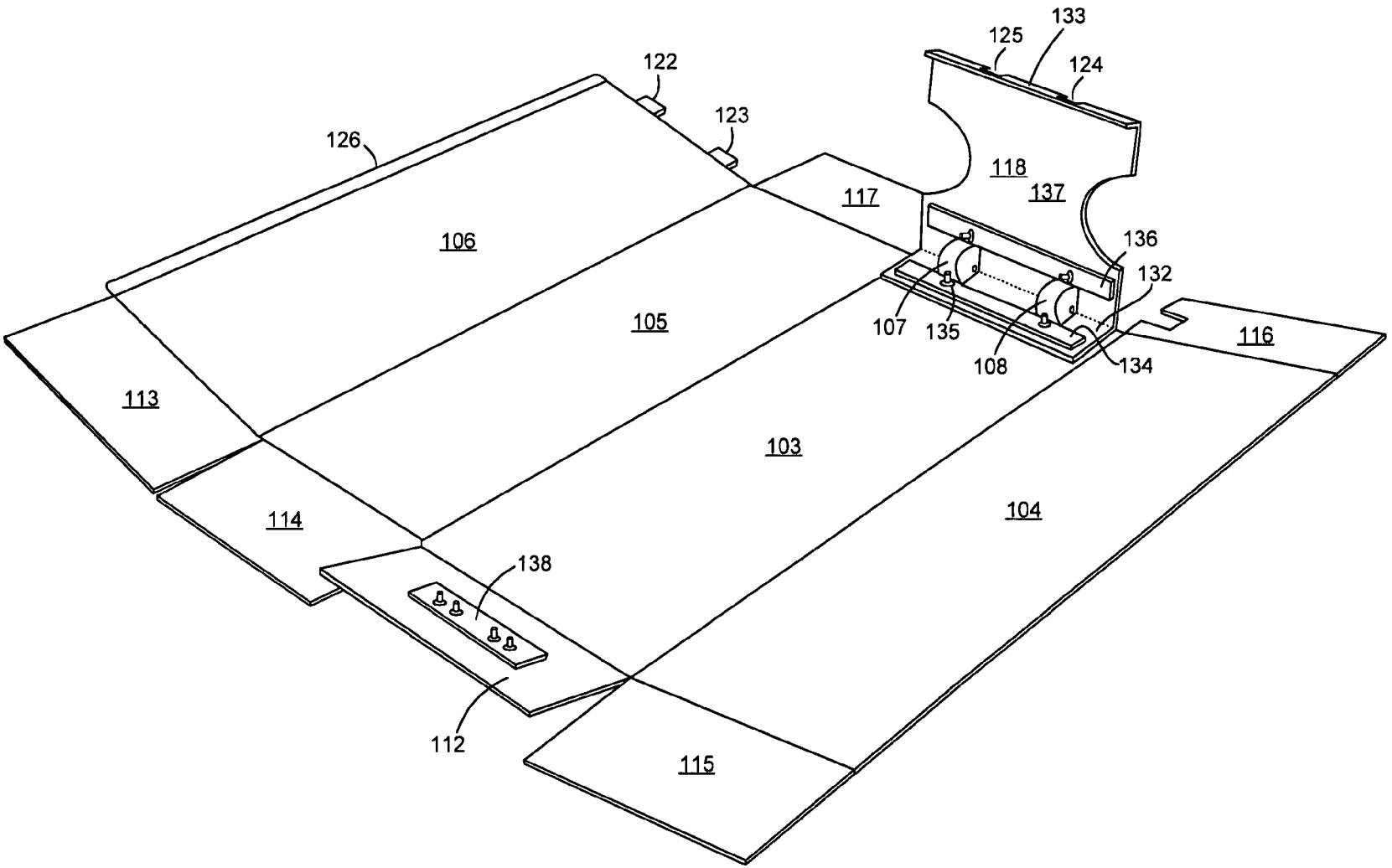
FIG. 6 is a view the roller box of the roller box assembly of FIG. 3, when the roller box is partially disassembled to reveal how the bottom insert portion is attached to the first sidewall of the box portion.

FIG. 6 is a view of roller box 102 when it is partially disassembled. In the view of FIG. 6, the flaps of the top and bottom portions are opened, and a glued joint between sidewalls 104 and 106 is broken such that the various panels (103-106, 112-117) can be unfolded. In the presently described embodiment, the panels 103-106 and 112-117 are different parts of a single piece of cardboard as illustrated in FIG. 6. A lip extension 126 is provided along the edge of sidewall 106 for attaching sidewall 106 to sidewall 104.

Figure 7:
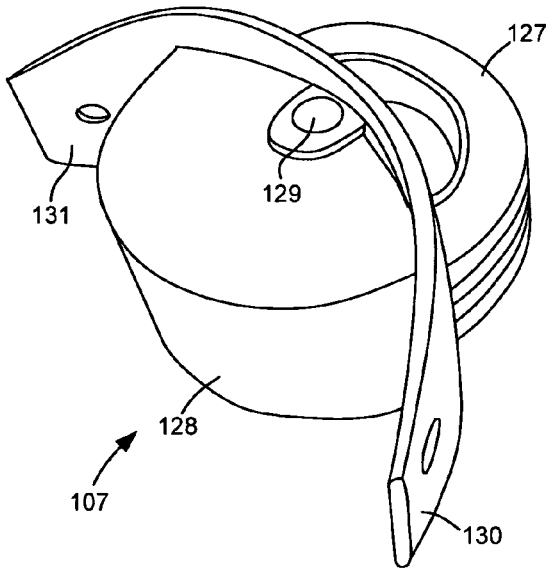
FIG. 7 is a perspective view of one of the wheels of the roller box assembly.

In the view of FIG. 6, the bottom insert portion 118 is shown attached to sidewall 103. FIG. 7 is a perspective view of wheel 107. Wheel 108 is identical to wheel 107. Wheel 107 is made of hardened plastic and includes a wheel 127, a wheel housing 128, and an axle 129. Wheel housing 128 includes two attachment extensions 130 and 131, each of which is provided with a hole for receiving a retaining bolt. Attachment extension 130 forms a flat surface that extends in a first plane, and attachment extension 131 forms a flat surface that extends in a second plane, where the two planes are perpendicular to each other. Bottom insert portion 118 includes folded up edge portions 132 and 133 for engaging sidewalls 103 and 106, respectively. Bottom insert portion 118 is attached to sidewall 103 by placing the attachment extension 130 of wheel 107 on the underside side (in the position illustrated) of panel 103. The threaded shaft of a bolt is extended up through the hole in attachment portion 130, through a hole in sidewall 103, through a hole in edge portion 132, and up through a hole in a rigid strip member 134. A nut 135 engages threads on the shaft of the bolt such that a washer on the top side (as illustrated) of rigid strip member 134 sandwiches rigid strip member 134, edge portion 132, and sidewall 103 between the washer and attachment extension 130. The combination of edge portion 132 and rigid strip member 134 serve to distribute the force due to the weight of the box and its contents from wheels 107 and 108 into sidewall 103. A second rigid strip member 136 and sets of nuts and bolts attach the wheels 107 and 108 to the base portion 137 of bottom insert portion 118 as illustrated. A third rigid strip 138 and sets of nuts and bolts attach the handle 109 to top flap 112 as illustrated.

Figure 8:
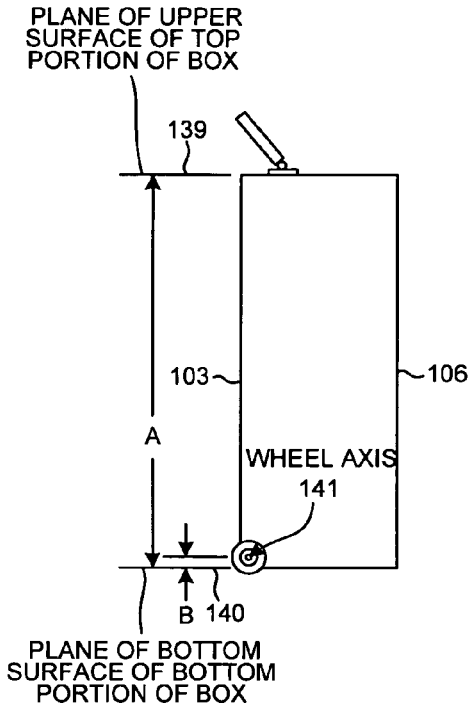
FIG. 8 is a side view of the roller box assembly of FIG. 3.

FIG. 8 is a side view of the roller box assembly of FIG. 3. Distance A between the plane 139 of the upper surface of top portion 100 and the plane 140 of the bottom surface of bottom portion 101 is at least three feet in this embodiment. The axis 141 of wheels 107 and 108 extends in a line parallel to plane 139 and parallel to plane 140 such that the line is located between the two planes but does not intersect either plane. In the embodiment of FIG. 8, the line of axis 141 is also located between the vertically-extending plane of sidewall 103 and the vertically-extending plane of sidewall 106.

Figure 9:
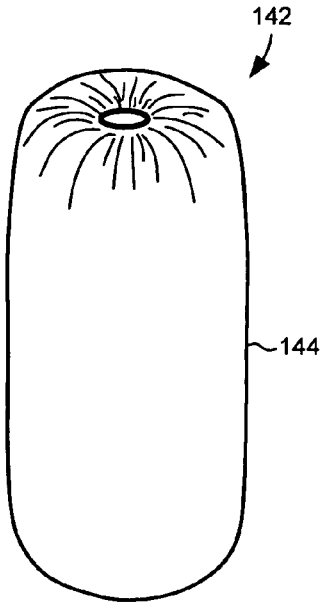
FIG. 9 is a perspective view of the bedding product that is contained in the box portion of the roller box assembly of FIG. 3.
Figure 10:
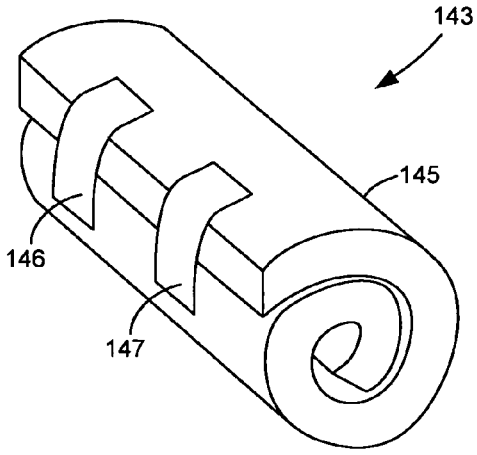
FIG. 10 is a perspective view of the compressed and rolled mattress of the bedding product of the roller box assembly of FIG. 3.

FIG. 9 is a diagram of bedding product 142 that is contained in roller box 102 of the roller box assembly of FIG. 3. Bedding product 142 in this example includes a compressed and rolled up pocket coil innerspring mattress 143 and a cylindrical-shaped bag 144. In one example, the mattress is placed in a first bag 145, and the mattress is compressed between two surfaces so that it appears as a flattened mattress disposed in the first bag. Air is prevented from reentering the first bag, thereby facilitating keeping the mattress in its flattened compressed state. The flattened compressed mattress in first bag 145 is rolled into a cylinder form. Pieces 146 and 147 of tape are applied to prevent the roll from unrolling. The result appears as illustrated in FIG. 10. The roll of FIG. 10 is then placed in second bag 144. Second bag 144 has a cylindrical-shape that has a diameter substantially equal to the width of the panels 103-106. Second bag 144 has a drawstring (not shown) for pulling the upper end of the bag closed. The resulting bedding product 142 is illustrated in FIG. 9. Bedding product 142 is slid into the open top of the roller box, and the flaps 112-115 are folded down and taped in place so that the roller box assembly appears as illustrated in FIG. 3. For additional information on one example of bedding product 142, see: U.S. patent application Ser. No. 11/458,359, filed Jul. 18, 2006, entitled "Method Of Packaging An Innerspring Mattress", by Youn Jae Lee (the subject matter of which is incorporated herein by reference).

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An assembly comprising:

a roller box comprising:

a box portion having a bottom portion, a plurality of sidewalls, and a top portion, wherein the bottom portion meets a first of the sidewalls to define a corner edge of the box portion, and wherein the box portion has a height and a width;

a first wheel disposed along the corner edge at a first location; and a second wheel disposed along the corner edge at a second location, wherein the first wheel and the second wheel have a common and fixed axis of rotation, wherein the top portion has an upper surface, and the bottom portion has a bottom surface, and wherein the common and fixed axis of rotation of the first wheel and the second wheel extends parallel to the upper surface and to the bottom surface and between the upper surface and the bottom surface; and a mattress contained in the box portion, wherein the mattress is rolled into a cylindrical shape with a diameter substantially equal to the width of the box portion and a length substantially equal to the height of the box portion.

2. An assembly comprising:

a roller box comprising:

a box portion having a bottom portion, a plurality of sidewalls, and a top portion, wherein the bottom portion meets a first of the sidewalls to define a corner edge of the box portion, and wherein the box portion has a height and a width;

a first wheel disposed along the corner edge at a first location; and a second wheel disposed along the corner edge at a second location, wherein the first wheel and the second wheel have a common and fixed axis of rotation, wherein the top portion has an upper surface that extends in a first plane, wherein the bottom portion has a bottom surface that extends in a second plane, wherein the common and fixed axis extends in a line, wherein the line is parallel to the first and second planes and does not intersect either the first or second plane, and wherein the line extends between the first and second planes; and a mattress contained in the box portion, wherein the mattress is rolled into a cylindrical shape with a diameter substantially equal to the width of the box portion and a length substantially equal to the height of the box portion.

3. An assembly comprising:

a roller box comprising:

a box portion having a bottom portion, a plurality of sidewalls, and a top portion, wherein the bottom portion meets a first of the sidewalls to define a corner edge of the box portion, and wherein the box portion has a height and a width;

a first wheel disposed along the corner edge at a first location;

a second wheel disposed along the corner edge at a second location, wherein the first wheel and the second wheel have a common and fixed axis of rotation; and a rigid strip member, wherein the rigid strip member extends lengthwise parallel to the corner edge, wherein the first wheel is coupled to the rigid strip member, wherein the second wheel is coupled to the rigid strip member, and wherein the rigid strip member is immovably attached to a single one of the plurality of sidewalls; and a mattress contained in the box portion, wherein the mattress is rolled into a cylindrical shape with a diameter substantially equal to the width of the box portion and a length substantially equal to the height of the box portion.

4. An apparatus comprising:

a cardboard box having a height of at least three feet and a width, wherein the cardboard box contains a mattress rolled into a cylindrical shape with a diameter substantially equal to the width and a length substantially equal to the height;

a pull handle attached to a top portion of the cardboard box; and a pair of fixed-axis wheels disposed along a corner edge of a bottom portion of the cardboard box, wherein the top portion has an upper surface that extends in a first plane, wherein the bottom portion has a bottom surface that extends in a second plane, wherein each of the pair of fixed-axis wheels has an axis of rotation that extends in a line, wherein the line is parallel to the first and second planes and does not intersect either the first plane or the second plane, wherein the line extends between the first and second planes, and wherein the pull handle extends outside the cardboard box from the upper surface.

5. The apparatus of claim 4, further comprising:

means for distributing and transferring force from the pair of fixed-axis wheels to a sidewall of the cardboard box.

6. The apparatus of claim 4, wherein the cardboard box has a vertically-extending front sidewall that extends in a third plane and a vertically-extending back sidewall that extends in a fourth plane, and wherein the line is also located between the third plane and the fourth plane.

7. The apparatus of claim 6, wherein the line is closer to the third plane than to the fourth plane, and wherein the pull handle is attached to the top portion of the cardboard box closer to the third plane than to the fourth plane.

8. The apparatus of claim 7, wherein the pair of fixed-axis wheels are attached to the cardboard box by bolts that extend through a rigid strip member.

9. An apparatus comprising:

a cardboard box having a height of at least three feet and a width, wherein the cardboard box contains a mattress rolled into a cylindrical shape with a diameter substantially equal to the width and a length substantially equal to the height a pull handle attached to a top portion of the cardboard box; and means for rolling the cardboard box disposed along a corner edge of a bottom portion of the cardboard box, wherein the means has a fixed axis of rotation that extends in a line, wherein the top portion has an upper surface that extends in a first plane, and the bottom portion has a bottom surface that extends in a second plane, wherein the line is parallel to the first and second planes and does not intersect either the first plane or the second plane, wherein the line extends between the first and second planes, and wherein the pull handle extends outside the cardboard box from the upper surface.

10. The apparatus of claim 9, wherein the rolled mattress is a compressed coil innerspring mattress.

11. The apparatus of claim 9, wherein the rolled mattress is taped to prevent the rolled mattress from unrolling.

12. The apparatus of claim 9, wherein the rolled mattress is contained in a bag from which air has been evacuated.

* * * * *